US007137527B2

(12) United States Patent
Kageyama et al.

(10) Patent No.: US 7,137,527 B2
(45) Date of Patent: Nov. 21, 2006

(54) CONTAINER

(75) Inventors: Hidehei Kageyama, Kawagoe (JP); Tadashi Keda, Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 218 days.

(21) Appl. No.: 10/698,624

(22) Filed: Nov. 3, 2003

(65) Prior Publication Data

US 2004/0232160 A1 Nov. 25, 2004

(30) Foreign Application Priority Data

May 22, 2003 (JP) ..... 2003-145477

(51) Int. Cl.
*B65D 43/18* (2006.01)

(52) U.S. Cl. ..... 220/824; 220/820; 220/254.4; 215/236; 222/557

(58) Field of Classification Search ..... 220/254.4, 220/820, 824, 253; 215/236; 222/557
See application file for complete search history.

(56) References Cited

U.S. PATENT DOCUMENTS 1,007,425 A * 10/1911 Bowditch ..... 222/445
1,254,222 A * 1/1918 Gerhardt ..... 222/557
2,488,120 A * 11/1949 Ferriday, Jr. ..... 222/545
3,140,020 A * 7/1964 Spier ..... 222/517
3,889,847 A * 6/1975 Uroshevich et al. ..... 221/265
4,183,443 A * 1/1980 DeParales et al. ..... 220/714
4,412,625 A * 11/1983 Zander ..... 215/223
4,657,139 A * 4/1987 Hanifl ..... 220/821
5,167,338 A * 12/1992 Kick ..... 220/253
6,024,217 A * 2/2000 Ponsi et al. ..... 206/370
6,082,575 A * 7/2000 Skoskiewicz et al. ..... 220/711
6,332,551 B1 * 12/2001 Copeland ..... 220/262
6,382,410 B1 * 5/2002 Magid et al. ..... 206/38.1
6,547,102 B1 * 4/2003 Stoneberg ..... 222/143
6,651,833 B1 * 11/2003 Sciarini ..... 215/236

* cited by examiner

*Primary Examiner*—Nathan J. Newhouse
*Assistant Examiner*—James Smalley
(74) *Attorney, Agent, or Firm*—McGinn IP Law Group, PLLC

(57) ABSTRACT

To provide a container that can be easily configured and has good operability when opened and closed with one hand. The container includes a container body having an opening, and a lid body that can open and close the opening of the container body, wherein the container body has, near the opening, a journaling portion that supports the lid body rotatably around an axis orthogonal to an opening surface of the opening, while the lid body has a journaled portion that is journaled by the journaling portion, and a lid portion, and the lid body rotates around the journaling portion to allow the lid portion to move to a position for covering the opening and a position for exposing the opening.

15 Claims, 7 Drawing Sheets

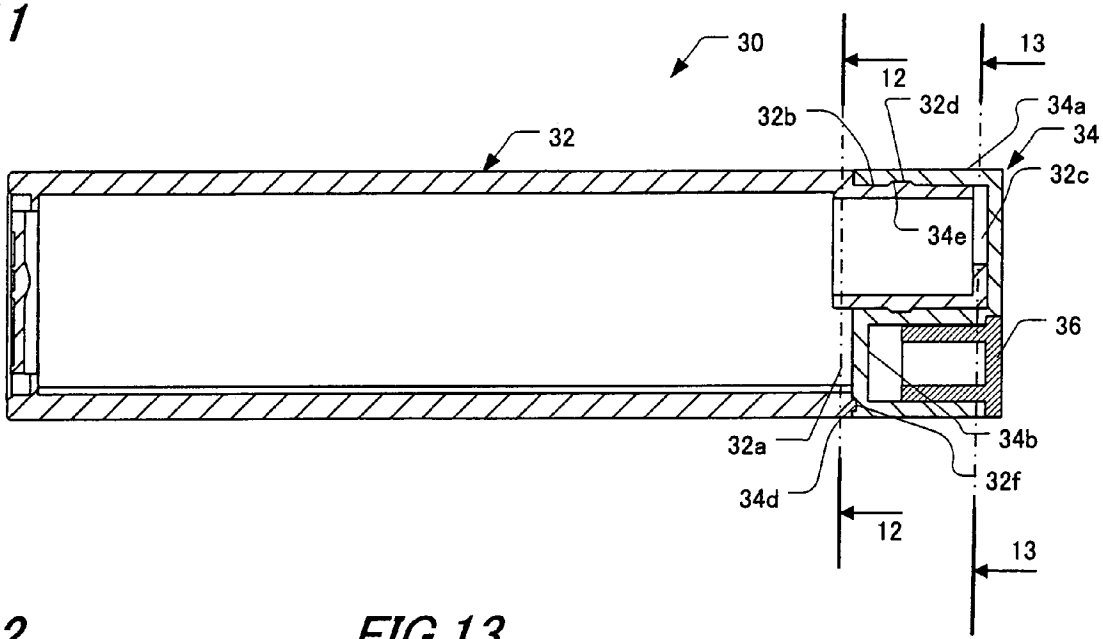
FIG. 11
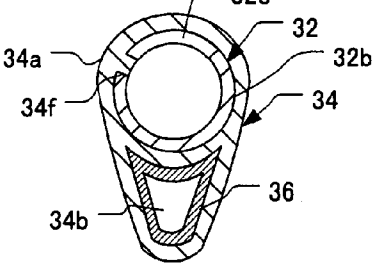
FIG. 12
FIG. 13
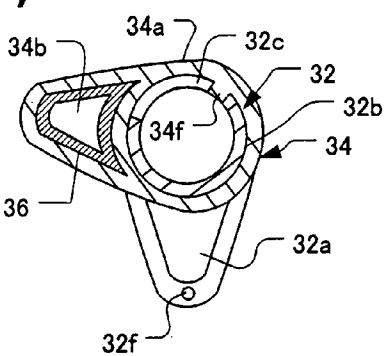
FIG. 14

CONTAINER

BACKGROUND OF THE INVENTION

1. Field of the Invention

The present invention relates to a container.

2. Description of the Related Art

A widely known container for containing, for example, mechanical pencil leads includes a container body having an opening, and a lid body that can open and close the opening of the container body, the lid body being removable from the container body. However, such a container cannot be operated with one hand.

Thus, several containers that can be operated with one hand are proposed (for example, Japanese Patent Laid-Open No. 10-272885 (JP10272885A) and Japanese Utility Model Publication No. 61-34156)(JP6134156U).

In Japanese Patent Laid-Open No. 10-272885, a container includes a container body, a container cover, and a lid body. The container cover has a straight guide groove and a bent opening/closing guide groove. An engagement protrusion provided on the container body movably engages the straight guide groove via a throughhole provided on a protruding portion of the lid body, and also an opening/closing support protrusion provided on the protruding portion of the lid body movably engages the opening/closing guide groove. When the container body is linearly slid with respect to the container cover, the engagement protrusion of the container body moves along the straight guide groove, the lid body that the engagement protrusion penetrates follows the movement of the engagement protrusion, and the opening/closing support protrusion of the lid body is guided to the opening/closing guide groove of the container cover. Because the opening/closing guide groove is bent, the lid body is rotated to open an opening of the container body.

In Japanese Utility Model Publication No. 61-34156, a container includes a lead containing cylinder and a lid body rotatably and concentrically attached to the lead containing cylinder. A lead guiding groove for separately placing one of leads in a taking-out position is formed inside the lead containing cylinder, and a lead protruding hole is bored in the lid body. The lid body is rotated with respect to the lead containing cylinder to align the lead protruding hole with the lead guiding groove, then the lead separately placed by the lead guiding groove can be taken out of the lead protruding hole. If the lid body is rotated with respect to the lead containing cylinder, and the lead protruding hole is not aligned with the lead guiding groove, the lead cannot be taken out of the lead containing cylinder.

However, in Japanese Patent Laid-Open No. 10-272885, a configuration for rotating the lid body is complex. In Japanese Utility Model Publication No. 61-34156, the lid body has to be concentrically rotated with respect to the lead containing cylinder, and such a rotating operation is hard to perform with one hand.

SUMMARY OF THE INVENTION

The present invention is achieved in view of the above described problems, and has an object to provide a container that can be easily configured and has good operability when opened and closed with one hand.

In order to achieve the above described object, a container according to the present invention includes a container body having an opening, and a lid body that can open and close the opening of the container body, wherein the container body has, near the opening, a journaling portion that supports the lid body rotatably around an axis orthogonal to an opening surface of the opening, and the lid body has a journaled portion that is journaled by the journaling portion, and a lid portion, and the lid body rotates around the journaling portion to allow the lid portion to move to a position for covering the opening and a position for exposing the opening.

The lid body can be rotated with respect to the container body by holding the container body with one hand and touching the lid body with a finger or thumb, thus allowing easy opening and closing with one hand, and increasing operability. The container can be constituted by the container body and the lid body, and can be easily configured, thus reducing the number of components.

The journaling portion can be provided in parallel with the opening. According to this configuration, the lid body rotates around the journaling portion to allow the lid portion to move between the position for covering the opening and the position for exposing the opening.

The lid body can be noncircular when viewed from a direction orthogonal to the opening surface. According to this configuration, the lid body can be operated by touching a part of the noncircular lid body with the finger of thumb, thus increasing operability. The noncircular shape may include a shape having a tapered sharp portion, an elliptical shape, or an oval shape, and the lid portion may be positioned in the sharp portion or an end of the elliptical or oval shape.

The container body has a vertical wall formed along an edge of the opening, and when the lid portion is in the position for covering the opening, a part of the lid body is placed along a part of the vertical wall. Because the part of the lid body is placed along the part of the vertical wall, the lid body and the container body can be integrally constituted when the lid body is closed. Also, the lid body can be lockably connected to the vertical wall. According to the configuration, the lid body, when closed, can be reliably kept in a closed state.

The container can further include rotation range controller for controlling a rotation angle of the lid body.

The rotation range controller can include a protrusion provided on one of the journaling portion and the journaled portion, and a notch provided on the other of the journaling portion and the journaled portion.

The present disclosure relates to subject manner contained in Japanese Patent Application No. 2003-145477, filed on May 22, 2003, which is expressly incorporated herein by reference in its entirety.

BRIEF DESCRIPTION OF THE DRAWINGS

FIG. 11 is a vertical sectional view of a container according to a third embodiment of the invention;

FIG. 12 is a sectional view taken along the line 12—12 in FIG. 11;

FIG. 13 is a sectional view taken along the line 13—13 in FIG. 11; and FIG. 14 is a view corresponding to FIG. 13 when an opening of a container body is opened.

DETAILED DESCRIPTION OF THE PREFERRED EMBODIMENTS

Now, embodiments of the invention will be described with reference to the drawings.

(First Embodiment)

Figure 2:
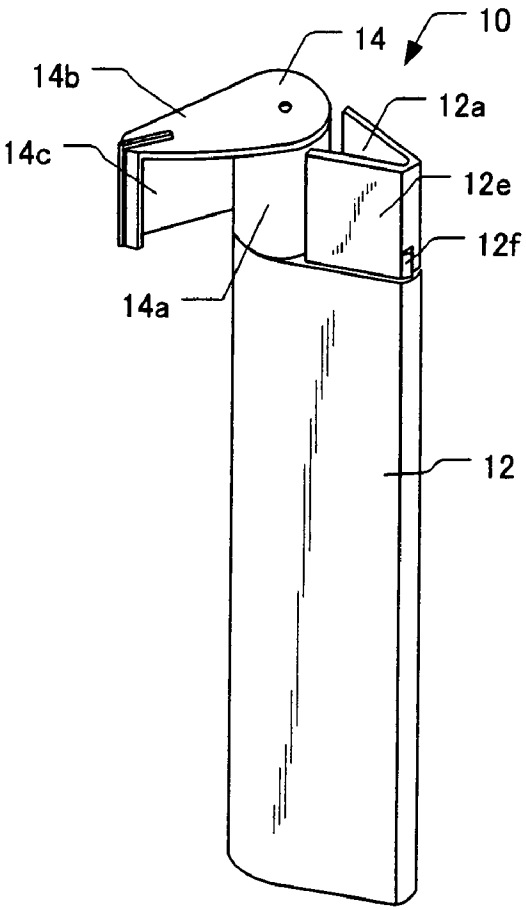
FIG. 2 is a perspective view of the container according to the first embodiment of the invention when the opening of the container body is opened.
Figure 1:
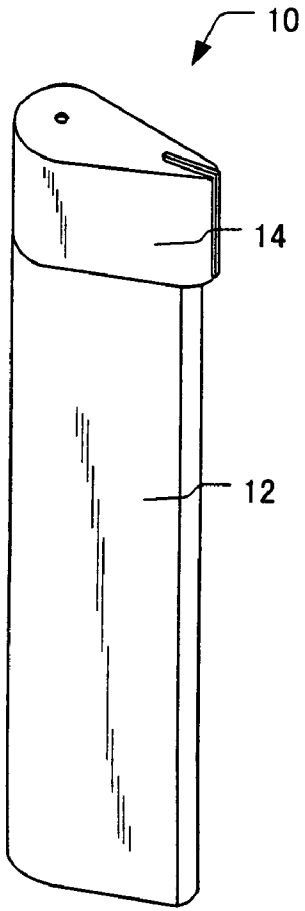
FIG. 1 is a perspective view of a container according to a first embodiment of the invention when an opening of a container body is closed.

FIGS. 1 and 2 are perspective views of a container according to a first embodiment of the invention, and FIG. 1 shows a state where an opening of a container body is closed, whereas FIG. 2 shows a state where the opening of the container body is opened.

In FIGS. 1 and 2, a container 10 includes a container body 12 having an internal space, and a lid body 14 that can open and close an opening 12*a* of the container body 12. The container body 12 and the lid body 14 are noncircular when viewed in a longitudinal direction of the container 10 orthogonal to an opening surface of the opening 12*a*. In this embodiment, the noncircular shape has a circular portion and a tapered sharp portion of a triangle integrally formed into a comet shape.

Figure 3:
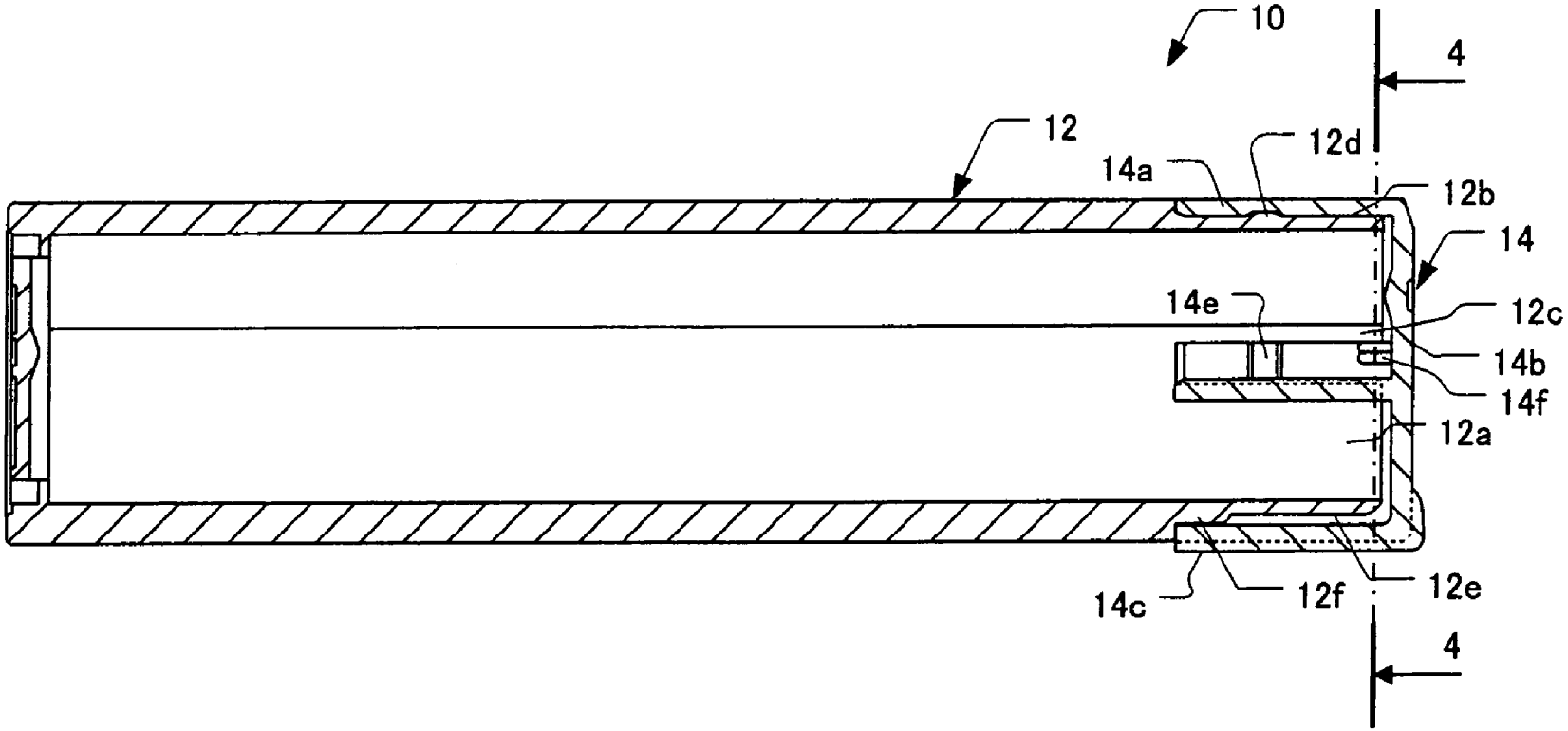
FIG. 3 is a vertical sectional view of the container according to the first embodiment of the invention.
Figure 6A:
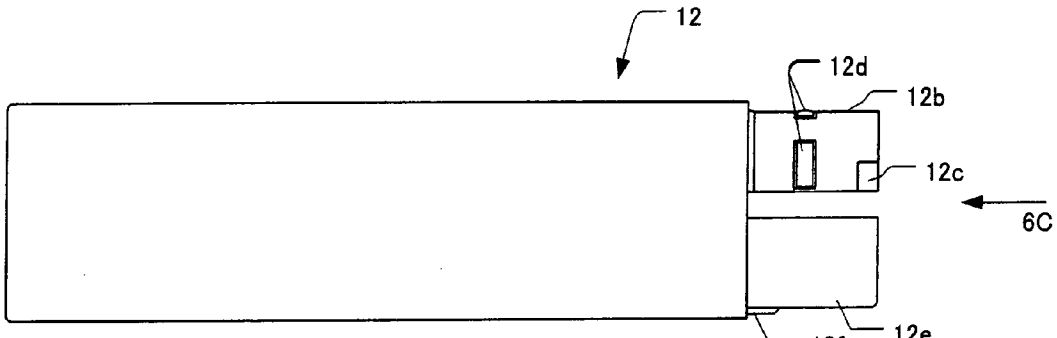
FIG. 6A is a side view of the container body.
Figure 6B:
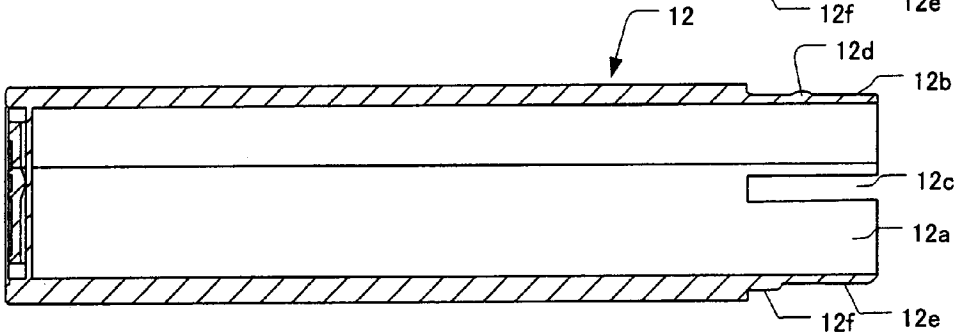
FIG. 6B is a sectional view taken along the line 6B—6B in FIG. 6C.
Figure 6C:
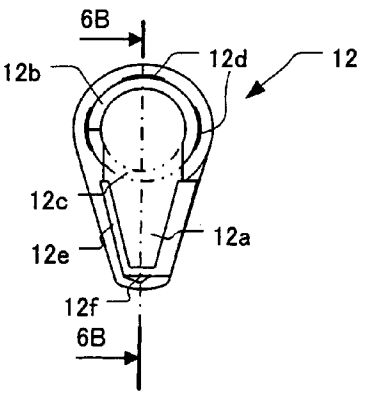
FIG. 6C is a view taken in the direction of the arrow 6C of FIG. 6A.

The container body 12 is closed at its bottom as shown in FIGS. 3 and 6, and has, at its top opposite from the bottom, the opening 12*a* and a journaling portion 12*b* adjacent to the opening 12*a*. The journaling portion 12*b* is provided in parallel with the opening 12*a*, and forms a cylindrical shape having a notch 12*c* on one side. An axis of the journaling portion 12*b* is parallel to the direction orthogonal to the opening surface of the opening 12*a*. The opening 12*a* is positioned in the sharp portion of the noncircular shape.

On an outer peripheral surface of the journaling portion 12*b*, a circumferentially extending protruding portion 12*d* is formed. The container body 12 has a vertical wall 12*e* formed along an edge of the opening 12*a*. The vertical wall 12*e* is bent along a tip edge of the sharp portion of the triangle, and a locking protrusion 12*f* is formed on the bent portion.

Figure 7B:
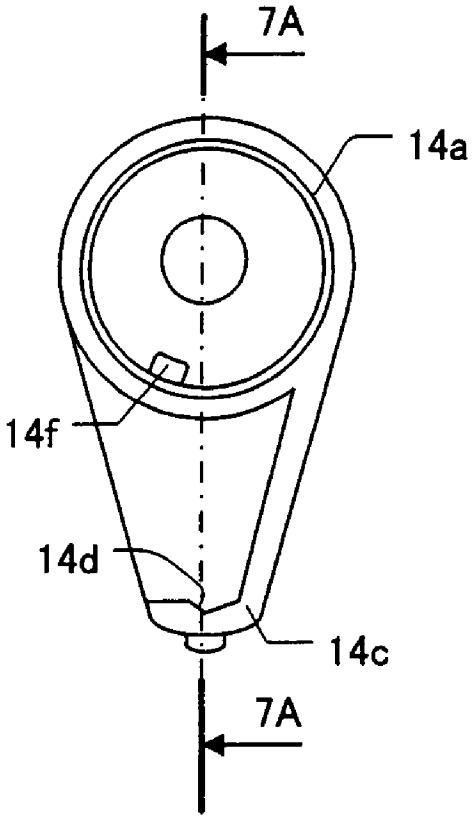
FIG. 7B is a view taken in the direction of the arrow 7B of FIG. 7A.
Figure 7A:
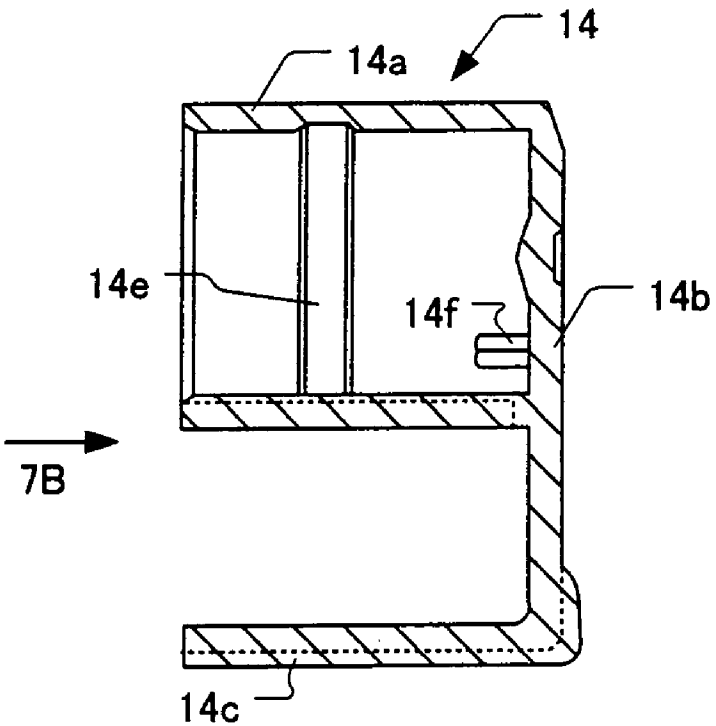
FIG. 7A is a sectional view taken along the line 7A—7A in FIG. 7B.

The lid body 14 includes, as shown in FIGS. 3 and 7, a cylindrical journaled portion 14*a*, a lid portion 14*b* that closes the top, and a locking piece 14*c* extending from the journaled portion 14*a* or the lid portion 14*b* tangentially with respect to the journaled portion 14*a*. The lid portion 14*b* is positioned on the side of the sharp portion. On an inner peripheral surface of the journaled portion 14*a*, an annular recess 14*e* that engages the protruding portion 12*d* of the journaling portion 12*b* of the container body 12 is formed, and thus the journaled portion 14*a* rotatably engages the journaling portion 12*b*. On the inner peripheral surface of the journaled portion 14*a*, a protrusion 14*f* protruding radially inward is formed, and the protrusion 14*f* is placed in the notch 12*c* of the journaling portion 12*b*.

On a tip of the locking piece 14*c*, a locked portion 14*d* is formed so as to be locked to the locking protrusion 12*f* of the container body 12, and thus the locking piece 14*c* is lockable to the vertical wall 12*e*.

The journaled portion 14*a* of the lid body 14 is journaled by the journaling portion 12*b* of the container body 12 so that the lid body 14 can rotatably swing around the journaling portion 12*b* of the container body 12. A rotation range is a range of angles through which the protrusion 14*f* can move within the notch 12*c*. The protrusion 14*f* and the notch 12*c* constitute rotation range controller. It is of course possible that a protrusion provided on the journaling portion 12*b* of the container body 12 and a notch provided on the journaled portion 14*a* of the lid body 14 similarly constitute rotation range controller.

Figure 4:
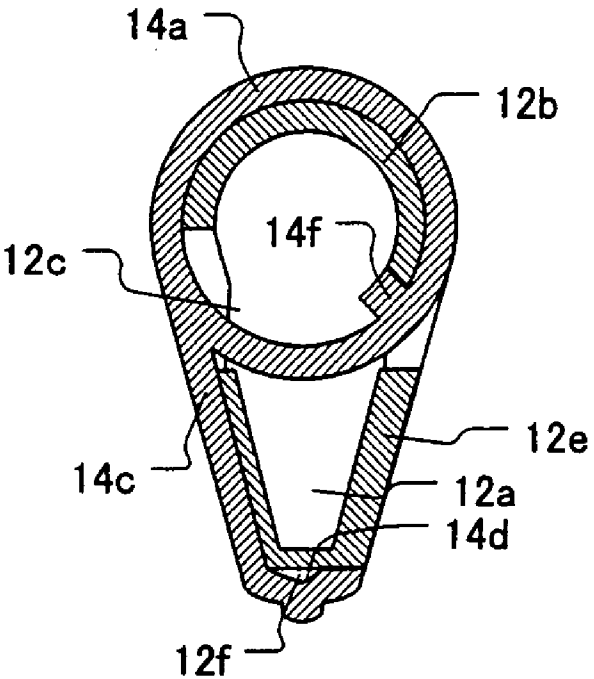
FIG. 4 is a sectional view taken along the line 4—4 in FIG. 3.

The container 10 configured as described above operates as follows. As shown in FIGS. 1 and 4, in a state where the lid body 14 closes the opening 12*a* of the container body 12, the locking piece 14*c* is placed along a part of the vertical wall 12*e*, the locked portion 14*d* on the tip of the locking piece 14*c* is locked to the locking protrusion 12*f* of the vertical wall 12*e*, and the lid body 14 and the container body 12 are integrally assembled. The lid portion 14*b* of the lid body 14 covers the opening 12*a* so that the contents of the container body 12 are safely contained in the internal space of the container body 12.

Then, the lid body 14 is rotated by holding the container body 12 and pushing the locking piece 14*c* of the lid body 14 with one finger (for example, a thumb). The lid body 14 is noncircular as described above, and can be operated by touching the sharp portion, thus the lid body 14 can be easily rotated around the journaling portion 12*b*.

Figure 5:
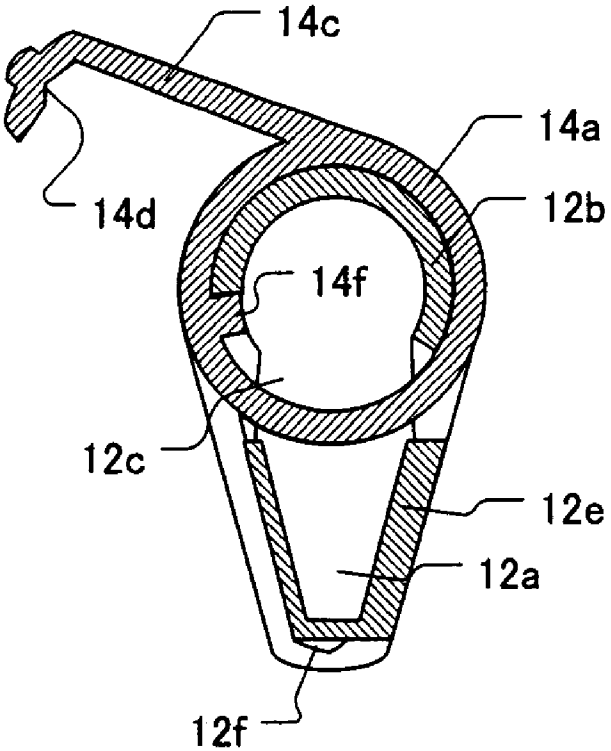
FIG. 5 is a view corresponding to FIG. 4 when the opening of the container body is opened.

The protruding portion 12*d* and the annular recess 14*e* preferably engage with little play therebetween. Thus, a friction force generated between the lid body 14 and the container body 12 stops the lid body 14 at the position where the hand is removed after the lid body 14 is rotated. When the lid body 14 is further rotated, the protrusion 14*f* moves to one of ends of the notch 12*c* to abut against one of wall surfaces of the journaling portion 12*b* as shown in FIG. 5, thus the lid body 14 cannot be further opened. In this state, the lid portion 14*b* of the lid body 14 moves from the opening 12*a* to expose the opening 12*a*. Thereby, the contents can be taken out of or inserted into the container body 12 through the opening 12*a*.

If the lid body 14 is rotated back to the original position by touching the locking piece 14*c* with the finger, the lid body 14 can close the container body 12 again.

(Second Embodiment)

Figure 8:
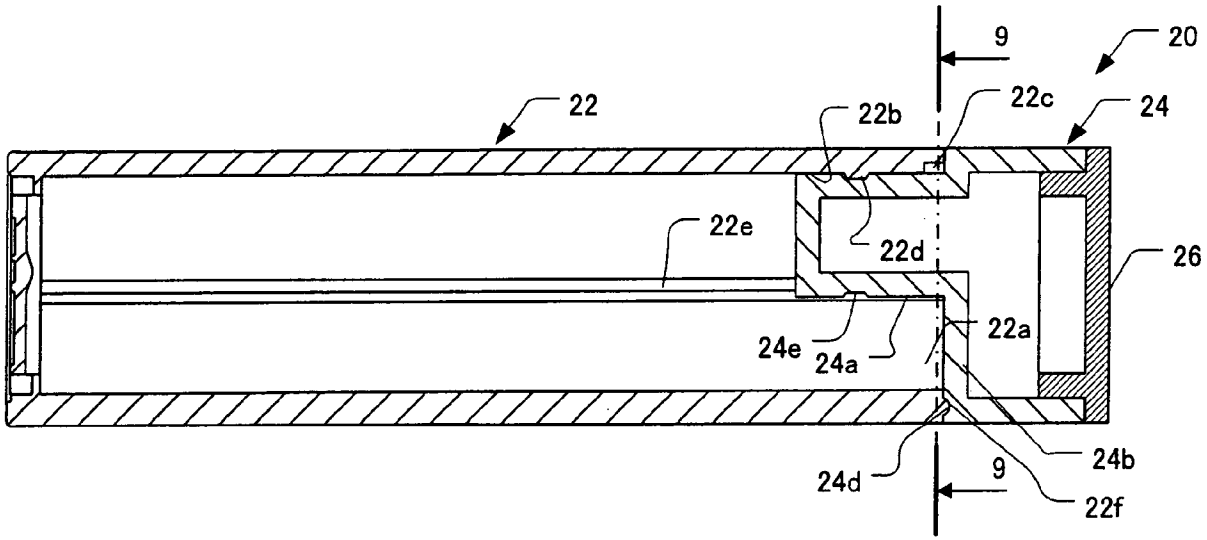
FIG. 8 is a vertical sectional view of a container according to a second embodiment of the invention.
Figure 10:
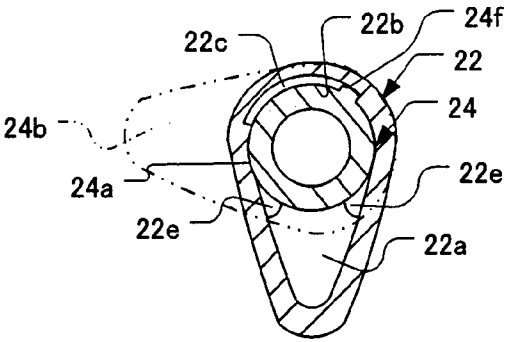
FIG. 10 is a view corresponding to FIG. 9 when an opening of a container body is opened.
Figure 9:
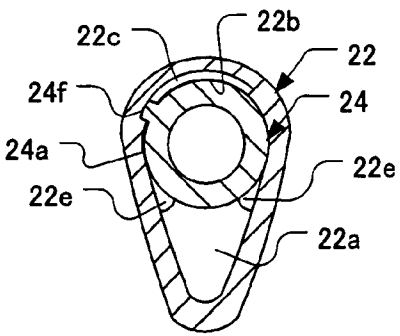
FIG. 9 is a sectional view taken along the line 9—9 in FIG. 8.

FIGS. 8 to 10 show a container according to a second embodiment of the invention.

In this embodiment, a container 20 includes a container body 22 having an internal space, and a lid body 24 that can open and close an opening 22*a* of the container body 22. The container body 22 and the lid body 24 are noncircular when viewed in a longitudinal direction of the container 20 orthogonal to an opening surface of the opening 22*a*. In this embodiment, the noncircular shape has a circular portion and a sharp portion of a triangle integrally formed into a comet shape.

The container body 22 is closed at its bottom, and has, at its top opposite from the bottom, the opening 22*a* and a journaling portion 22*b* adjacent to the opening 22*a*. The journaling portion 22*b* is provided in parallel with the opening 22*a*, and is a cylindrical recess surrounded by a rib 22*e*. On a tip of the journaling portion 22*b*, a notch 22*c* is circumferentially formed. An axis of the journaling portion 22*b* is parallel to the direction orthogonal to the opening surface of the opening 22*a*. The opening 22*a* is positioned in the sharp portion of the noncircular shape.

On an inner peripheral surface of the journaling portion 22*b*, a circumferentially extending protruding portion 22*d* is formed. A locking protrusion 22*f* is formed on an edge of the opening 22*a* of the container body 22.

The lid body 24 includes a cylindrical journaled portion 24*a*, and a lid portion 24*b* that covers the opening 22*a*. The lid portion 24*b* is positioned on the side of the sharp portion. Further, a plug 26 that closes a top of the lid body 24 may be provided. The plug 26 may be omitted, or the plug 26 and the lid body 24 may be integrally formed.

On an outer peripheral surface of the journaled portion 24*a*, an annular recess 24*e* that engages the protruding portion 22*d* of the journaling portion 22*b* of the container body 22 is formed so that the journaled portion 24*a* rotatably engages the journaling portion 22*b*. On the outer peripheral surface of the journaled portion 24*a*, a protrusion 24*f* protruding radially outward is formed, and the protrusion 24*f* is placed in the notch 22*c* of the journaling portion 22*b*.

On a tip of the lid portion 24*b*, a locked portion 24*d* is formed so as to be locked to the locking protrusion 22*f* of the container body 22, and thus the lid body 24 is lockable to the container body 22.

The journaled portion 24*a* of the lid body 24 is journaled by the journaling portion 22*b* of the container body 22, and the lid body 24 can rotatably swing around the journaling portion 22*b* of the container body 22. A rotation range is a range of angles through which the protrusion 24*f* can move within the notch 22*c*. The protrusion 24*f* and the notch 22*c* constitute rotation range controller.

As described above, the container 20 configured as described above provides the operation and the advantage similar to those of the first embodiment. As shown in FIGS. 8 and 9, in a state where the lid body 24 closes the opening 22*a* of the container body 22, the locked portion 24*d* is locked to the locking protrusion 22*f*. The lid portion 24*b* of the lid body 24 covers the opening 22*a* so that the contents of the container body 22 are safely contained in the internal space of the container body 22.

Then, the lid body 24 is rotated by holding the container body 22 and touching the sharp portion of the lid body 24 with one finger (for example, a thumb), thus the lid body 24 can be easily rotated around the journaling portion 22*b*.

The protruding portion 22*d* and the annular recess 24*e* preferably engage with little play therebetween. Thus, a friction force generated between the lid body 24 and the container body 22 stops the lid body 24 at the position where the hand is removed after the lid body 24 is rotated. When the lid body 24 is further rotated, the protrusion 24*f* moves to one of ends of the notch 22*c* to abut against one of wall surfaces of the journaling portion 22*b* as shown in FIG. 10, thus the lid body 24 cannot be further opened. In this state, the lid portion 24*b* of the lid body 24 moves from the opening 22*a* to expose the opening 22*a*. Thereby, the contents can be taken out of or inserted into the container body 22 through the opening 22*a*.

(Third Embodiment)

FIGS. 11 to 14 show a container according to a third embodiment of the invention.

In this embodiment, a container 30 includes a container body 32 having an internal space, and a lid body 34 that can open and close an opening 32*a* of the container body 32. The container body 32 and the lid body 34 are noncircular when viewed in a longitudinal direction of the container 30 orthogonal to an opening surface of the opening 32*a*. In this embodiment, the noncircular shape has a circular portion and a sharp portion of a triangle integrally formed into a comet shape.

The container body 32 is closed at its bottom, and has, at its top opposite from the bottom, the opening 32*a* and a journaling portion 32*b* adjacent to the opening 32*a*. The journaling portion 32*b* is provided in parallel with the opening 32*a*, and forms a cylindrical shape having a notch 32*c* on one side. An axis of the journaling portion 32*b* is parallel to the direction orthogonal to the opening surface of the opening 32*a*. The opening 32*a* is positioned in the sharp portion of the noncircular shape.

On an outer peripheral surface of the journaling portion 32*b*, a circumferentially extending protruding portion 32*d* is formed. A locking protrusion 32*f* is formed on an edge of the opening 32*a* of the container body 32.

The lid body 34 includes a cylindrical journaled portion 34*a*, and a lid portion 34*b* that covers the opening 32*a*. The lid portion 34*b* is positioned on the side of the sharp portion. Further, a plug 36 that closes a top of the lid portion 34*b* of the lid body 34 maybe provided. The plug 36 maybe omitted, or the plug 36 and the lid body 34 may be integrally formed.

On an inner peripheral surface of the journaled portion 34*a*, an annular recess 34*e* that engages the protruding portion 32*d* of the journaling portion 32*b* of the container body 32 is formed, so that the journaled portion 34*a* rotatably engages the journaling portion 32*b*. On the inner peripheral surface of the journaled portion 34*a*, a protrusion 34*f* (see FIG. 13) protruding radially inward is formed, and the protrusion 34*f* is placed in the notch 32*c* of the journaling portion 32*b*.

On a tip of the lid portion 34*b*, a locked portion 34*d* is formed so as to be locked to the locking protrusion 32*f* of the container body 32, and thus the lid body 34 is lockable to the container body 32.

The journaled portion 34*a* of the lid body 34 is journaled by the journaling portion 32*b* of the container body 32, and the lid body 34 can rotatably swing around the journaling portion 32*b* of the container body 32. A rotation range is a range of angles through which the protrusion 34*f* can move within the notch 32*c*. The protrusion 34*f* and the notch 32*c* constitute rotation range controller.

As described above, the container 30 configured as described above provides the operation and the advantage similar to those of the first and the second embodiments. As shown in FIGS. 11 and 13, in a state where the lid body 34 closes the opening 32*a* of the container body 32, the locked portion 34*d* is locked to the locking protrusion 32*f*. The lid portion 34*b* of the lid body 34 covers the opening 32*a* so that the contents of the container body 32 are safely contained in the internal space of the container body 32.

Then, the lid body 34 is rotated by holding the container body 32 and touching the sharp portion of the lid body 34 with one finger (for example, a thumb), thus the lid body 34 can be easily rotated around the journaling portion 32*b*.

The protruding portion 32*d* and the annular recess 34*e* engage with little play therebetween. Thus, a friction force generated between the lid body 34 and the container body 32 preferably stops the lid body 34 at the position where the hand is removed after the lid body 34 is rotated. When the lid body 34 is further rotated, the protrusion 34*f* moves to one of ends of the notch 32*c* to abut against one of wall surfaces of the journaling portion 32*b* as shown in FIG. 14, thus the lid body 34 cannot be further opened. In this state, the lid portion 34*b* of the lid body 34 moves from the opening 32*a* to expose the opening 32*a*. Thereby, the contents can be taken out of or inserted into the container body 32 through the opening 32*a*.

Each of the above described embodiments allows an easy operation with one hand, thus increasing operability. The container body and the lid body may be, of course, constituted by a plurality of parts, but the container can be constituted by at least the container body and the lid body, thus reducing the number of components.

While the principles of the invention have been described above in connection with specific embodiments, and particular modifications thereof, it is to be clearly understood that this description is made only by way of example and not as a limitation on the scope of invention.

What is claimed is:

1. A container comprising:

a container body comprising an opening and a vertical wall formed along an edge of said opening; and a lid body that can open and close the opening of said container body and includes a lid portion, said container body comprising a journaling portion that supports said lid body rotatably around an axis orthogonal to an opening surface of said opening, said lid body comprising a journaled portion that is journaled by said journaling portion, wherein said lid body rotates around said journaling portion to allow said lid portion to move to a position for covering the opening and a position for exposing the opening, and when said lid portion is in the position for covering the opening, a part of said lid body is placed along a part of the vertical wall of the container body; and an annular recess formed on an inner peripheral surface of said journaled portion that engages a protruding portion formed on said journaling portion, wherein said journaled portion rotatably engages said journaling portion, wherein said lid body comprises a noncircular shape when viewed from a direction orthogonal to the opening surface.

2. The container according to claim 1, wherein said journaling portion is provided in parallel with the opening.

3. The container according to claim 1, wherein said noncircular shape comprises a circular portion integrally formed with a tapered sharp portion.

4. The container according to claim 3, wherein said opening is positioned in said tapered sharp portion of said noncircular shape.

5. The container according to claim 3, wherein said vertical wall is bent along a tip edge of said tapered sharp portion.

6. The container according to claim 1, wherein said lid body and said container are integrally constituted when the lid body is in the position for covering the opening.

7. A container comprising:

a container body comprising an opening and a vertical wall formed along an edge of said opening; and a lid body that can open and close the opening of said container body and includes a lid portion, said container body comprising a journaling portion that supports said lid body rotatably around an axis orthogonal to an opening surface of said opening, said lid body comprising a journaled portion that is journaled by said journaling portion, wherein said lid body rotates around said journaling portion to allow said lid portion to move to a position for covering the opening and a position for exposing the opening, and when said lid portion is in the position for covering the opening, a part of said lid body is placed along a part of the vertical wall of the container body; and an annular recess formed on an inner peripheral surface of said journaled portion that engages a protruding portion formed on said journaling portion, wherein said journaled portion rotatably engages said journaling portion, wherein said lid body is lockably connected to said vertical wall.

8. A container comprising:

a container body comprising an opening and a vertical wall formed along an edge of said opening; and a lid body that can open and close the opening of said container body and includes a lid portion, said container body comprising a journaling portion that supports said lid body rotatably around an axis orthogonal to an opening surface of said opening, said lid body comprising a journaled portion that is journaled by said journaling portion, wherein said lid body rotates around said journaling portion to allow said lid portion to move to a position for covering the opening and a position for exposing the opening, and when said lid portion is in the position for covering the opening, a part of said lid body is placed along a part of the vertical wall of the container body;

an annular recess formed on an inner peripheral surface of said journaled portion that engages a protruding portion formed on said journaling portion, wherein said journaled portion rotatably engages said journaling portion; and a rotation range controller for controlling a rotation angle of the lid body.

9. The container according to claim 8, wherein said rotation range controller includes a protrusion provided on one of said journaling portion and said journaled portion, and a notch provided on the other of said journaling portion and said journaled portion.

10. A container comprising:

a container body comprising an opening and a vertical wall formed along an edge of said opening; and a lid body that can open and close the opening of said container body and includes a lid portion;

said container body comprising a journaling portion that supports said lid body rotatably around an axis orthogonal to an opening surface of said opening;

said lid body comprising a journaled portion that is journaled by said journaling portion, wherein said lid body rotates around said journaling portion to allow said lid portion to move to a position for covering the opening and a position for exposing the opening, and when said lid portion is in the position for covering the opening, a part of said lid body is placed along a part of the vertical wall of the container body, wherein said lid body comprises a noncircular shape when viewed from a direction orthogonal to the opening surface, wherein said noncircular shape comprises a circular portion integrally formed with a tapered sharp portion, and wherein said vertical wall is bent along a tip edge of said tapered sharp portion, and a lacking protrusion is formed on the bent portion of said vertical wall.

11. The container according to claim 10, wherein said lid body further comprises a locking piece extending from said journaled portion tangentially with respect to said journaled portion.

12. The container according to claim 11, wherein said locking piece comprises a locked portion formed on a tip of said locking piece so as to be locked with said locking protrusion to lockably connect said lid body to said vertical wall.

13. The container according to claim 12, wherein said locking piece is placed along a part of said vertical wall.

14. A container comprising:

a container body comprising an opening and a vertical wall formed along an edge of said opening; and a lid body that can open and close the opening of said container body and includes a lid portion, said container body comprising a journaling portion that supports said lid body rotatably around an axis orthogonal to an opening surface of said opening, said lid body comprising a journaled portion that is journaled by said journaling portion, wherein said lid body rotates around said journaling portion to allow said lid portion to move to a position for covering the opening and a position for exposing the opening, and when said lid portion is in the position for covering the opening, a part of said lid body is placed along a part of the vertical wall of the container body;

an annular recess formed on an inner peripheral surface of said journaled portion that engages a protruding portion formed on said journaling portion, wherein said journaled portion rotatably engages said journaling portion;

a notch formed in said journaling portion; and a protrusion protruding radially inward from the inner peripheral surface of said journaled portion, said protrusion placed in said notch of said journaling portion, wherein said protrusion and said notch interact to control a rotation angle of said lid body.

15. A container comprising:

a container body comprising an opening and a vertical wall formed along an edge of said opening; and a lid body that can open and close the opening of said container body and includes a lid portion, said container body comprising a journaling portion that supports said lid body rotatably around an axis orthogonal to an opening surface of said opening, said lid body comprising a journaled portion that is journaled by said journaling portion, wherein said lid body rotates around said journaling portion to allow said lid portion to move to a position for covering the opening and a position for exposing the opening, and when said lid portion is in the position for covering the opening, a part of said lid body is placed along a part of the vertical wall of the container body; and an annular recess formed on an inner peripheral surface of said journaled portion that engages a protruding portion formed on said journaling portion, wherein said journaled portion rotatably engages said journaling portion, wherein when said lid portion is in the position for covering the opening, said lid body can only be rotated in a direction in which the part of said lid body along said vertical wall separates from said vertical wall.

* * * * *